US007326155B2

(12) United States Patent
Kim

(10) Patent No.: US 7,326,155 B2
(45) Date of Patent: Feb. 5, 2008

(54) EXERCISE EXTENSION HANDLE

(75) Inventor: Yong Woo Kim, Rochester, NY (US)

(73) Assignee: Kellion Corporation, Rochester, NY (US)

( * ) Notice: Subject to any disclaimer, the term of this patent is extended or adjusted under 35 U.S.C. 154(b) by 139 days.

(21) Appl. No.: 11/231,614

(22) Filed: Sep. 21, 2005

(65) Prior Publication Data

US 2007/0066456 A1 Mar. 22, 2007

(51) Int. Cl.
*A63B 15/00* (2006.01)

(52) U.S. Cl. ..... 482/109; 482/38

(58) Field of Classification Search ..... 482/109–117, 482/38, 44–46

See application file for complete search history.

(56) References Cited

U.S. PATENT DOCUMENTS 4,973,043 A * 11/1990 Nolan ..... 482/45
5,356,166 A 10/1994 Hahne et al.
5,593,239 A 1/1997 Sallee
5,595,545 A 1/1997 O'Brien
5,888,146 A * 3/1999 Raynak ..... 473/229
6,248,031 B1 * 6/2001 Brodie ..... 473/560
6,537,184 B2 3/2003 Kim
6,599,200 B1 7/2003 Kallassy
2002/0137605 A1 9/2002 Olsen
2003/0153440 A1 8/2003 Kim

* cited by examiner

*Primary Examiner*—Lori Amerson
(74) *Attorney, Agent, or Firm*—Brown & Michaels, PC

(57) ABSTRACT

A handle for a swing-type exercising device has an adjustable shaft extender connectable to a resistance as the handle is swung for exercise purposes. The handle can also have an offset extension that allows a resistance to apply a torque force to the handle shaft as a swing approaches a hitting region. Split grips on the handle can be independently adjustable for rotation or non-rotation relative to the handle shaft so that resistance to the torque can be assigned to different hands holding the independent grips.

12 Claims, 7 Drawing Sheets

EXERCISE EXTENSION HANDLE

BACKGROUND

Many exercises involve moving a handle connected to an exercising resistance. In some cases, it is possible to vary the effort required to move the handle by extending from the handle a variable length of a handle shaft connected to the exercising resistance. An example of this is shown in U.S. Pat. No. 6,537,184, as applied to a swing exerciser that can be used by golfers.

The invention of this application adds exercisingly significant features to a handle for a swing exerciser. It makes the handle more effective in exercising the many muscles involved in a swing and also improves on the convenience and effectiveness of adjusting a handle to meet different exercise purposes.

SUMMARY

One feature that the invention adds to an exercising handle is a torque force to be resisted. The same resistance that works against the swing of the handle can also apply a torque that the person gripping the handle must overcome during the swing. The torque force is also preferably made variable. A preferred way of establishing the torque force is to connect the swing resistance to a position laterally offset from an axis of the handle shaft in a direction transverse to the swing as the swing approaches a hitting region. This tends to rotate the handle shaft, which the grip of the exerciser must overcome during a swing. The amount of the offset connection of the swing resistance can be varied to adjust the torque applied to the handle shaft during a swing.

The invention also adds a rotationally split grip to the handle and makes independent hand grips separately connectable rotationally to the handle shaft. One of the grips can be fixed to the handle shaft and the other grip made rotatable relative to the handle shaft so that one hand of the exerciser must work alone in overcoming the torque resistance. Preferably, both grips can also be rotationally locked to the handle shaft so that both hands can cooperate in overcoming the torque resistance.

The combination of features involving an extendible handle shaft, an offset resistance connection, and split and rotationally adjustable right and left hand grips allows the handle to perform several important exercising purposes in developing a swing for a sport such as golf. The invention is not limited to golf swing exercising, though, and can be applied to the swing of a hockey stick, baseball bat, polo mallet, etc.

DRAWINGS

FIG. 1 schematically shows a preferred embodiment of the inventive exercise extension handle;

FIGS. 2 and 3 schematically show partially cut-away views of a preferred embodiment of a locking collar shown in a locking position in FIG. 2 and in an unlocking position in FIG. 3.

DETAILED DESCRIPTION

Figure 1:
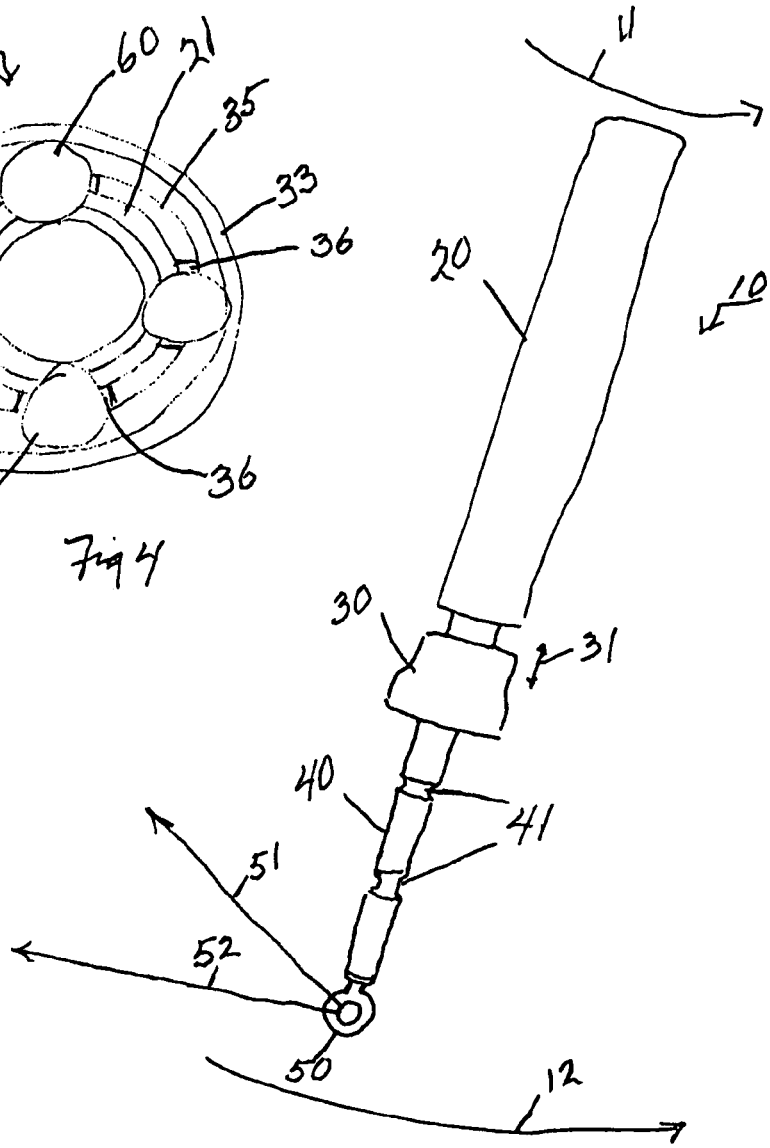

Exercise handle 10, as shown in FIG. 1, includes a grippable handle 20, a locking collar 30, an extendible shaft element 40, and a connector 50 to which one or more exercising resistances can be connected. Two such exercising resistances are shown schematically in FIG. 1 by vector arrows 51 and 52 extending from connector 50. Exercising handle 10 can be moved through a curved path to simulate a golf swing, or with different curved paths, handle 10 can simulate movement of a hockey stick, tennis racket, baseball bat, lacrosse stick, paddle ball racket, axe, etc. Curved lines 11 and 12 schematically illustrate the families of possible movements for handle 10.

When an exercising resistance such as 51 or 52 is applied at a distance from handle 20 then effort must be applied to handle 20 in proportion to the distance between handle 20 and connector 50. Extending this distance can increase the muscular effort needed to move the handle through the desired path, so that varying the extension of element 40 influences the muscles involved in the swing and the amount of effort required and thereby adjusts the handle to meet the exerciser's needs. In effect, varying the extension of shaft 40 changes a moment arm applied to handle 20 to work against the exercising resistance.

As shown by double headed arrow 31, locking element 30 is preferably movable toward and away from handle 20 for respectively unlocking and locking the extension distance of element 40. This allows a hand gripping handle 20 to pull or hold locking collar 30 in an unlocked position as shown in FIG. 3 while the extension of handle shaft 40 is adjusted with another hand. Release of locking collar 30 preferably moves it away from handle 20 to a locking position shown in FIG. 2, but this motion can be reversed.

Figure 2:
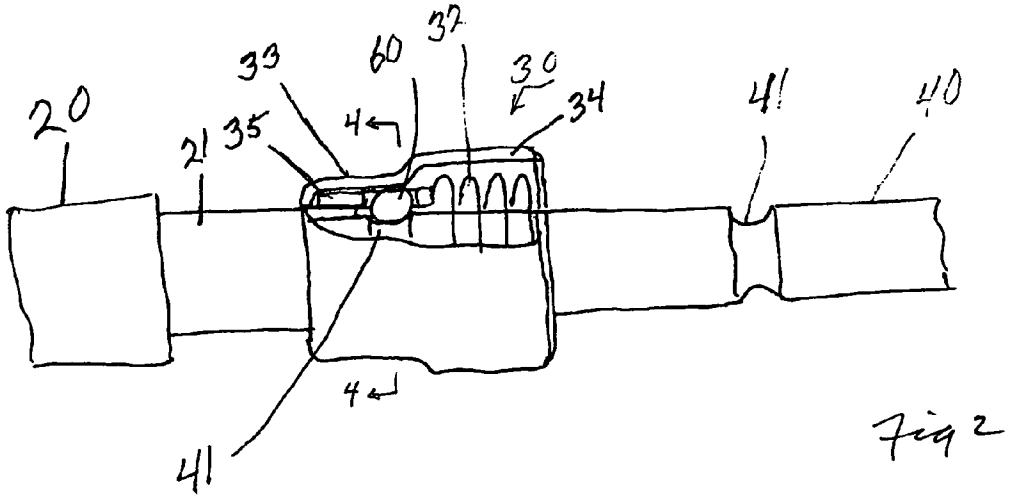
Figure 3:
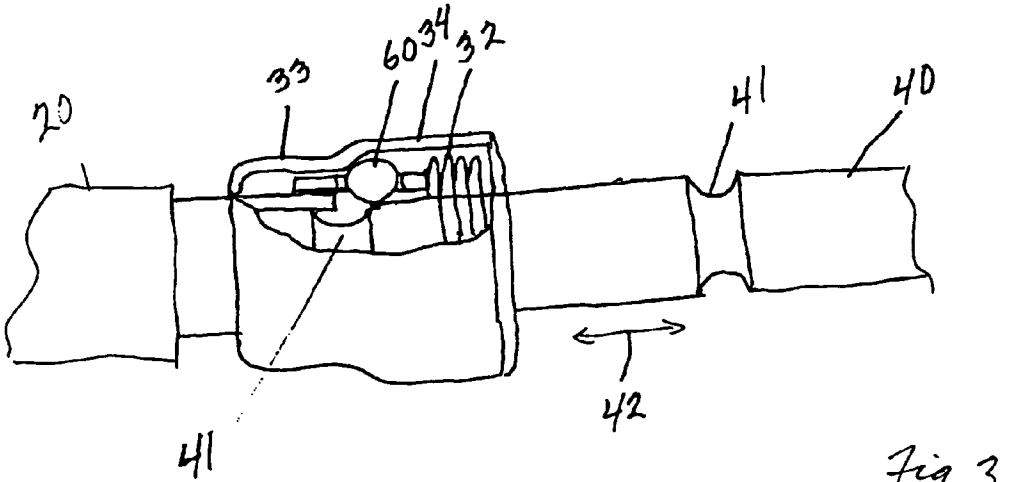

A schematically shown spring 32 is preferably contained within locking collar 30 and arranged to bias locking collar 30 to the locking position shown in FIG. 2. This moves a smaller diameter collar region 33 over locking balls 60 to hold or trap them within one of the grooves or detents 41 that are arranged along the length of extendible element 40. When locking collar 30 is pulled or held toward handle 20, as shown in FIG. 3, spring 32 compresses, and a larger diameter region 34 moves over locking balls 60 to release the balls from a groove 41. This allows element 40 to be moved inward or outward to a desired extended position, as shown by the double headed arrow 42 in FIG. 3.

A sleeve 21 extends from handle 20 into locking collar 30 where sleeve 21 connects to ball cage 35 that loosely carries locking balls 60. Ball cage 35 can also be formed as part of steeve 21. The balls 60 are held in groove 41 of element 40 by the constraint exerted by the smaller diameter region 33 of collar 30. A pair of cross bores 36 through ball cage 35 forms loose retaining pockets for balls 60. These are free to move radially when released under larger diameter region 34 of locking collar 30, and to move back into a groove 41 when required by the pressure of spring 32 and the reduced diameter region 33 of locking collar 30.

In operation, a hand gripping handle 20 can use a thumb to pull locking collar 30 from the locked position illustrated in FIG. 2 to the unlocked position illustrated in FIG. 3. Then another hand can move extension element 40 inward or outward to approach a desired extended position whereupon locking collar 30 can be released so that locking balls 60 will fall into the next groove 41 that they encounter along the axial movement of extendible element 40. This locks element 40 in that extended position for exercise purposes.

Figure 4:
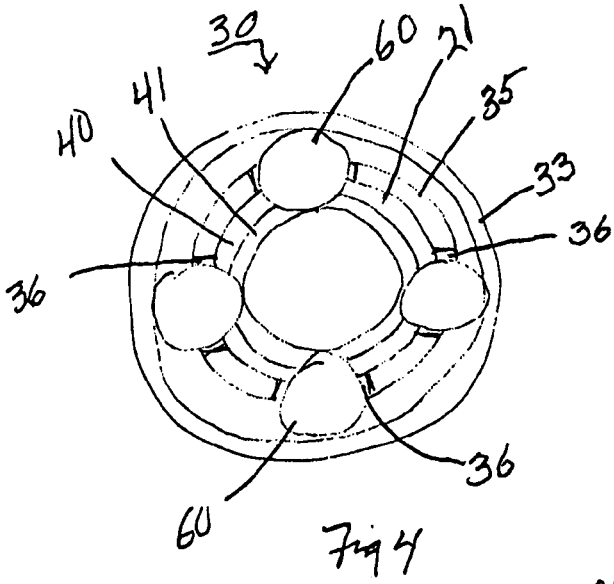
FIG. 4 is a partially schematic cross-sectional view, taken along the line 4-4 of FIG. 2.

The ball lock mechanism shown in FIGS. 2-4 allows extendible element 40 to rotate relative to handle 20, sleeve 21, and locking collar 30. This is possible because balls 60 are free to rotate around a groove 41 in which they are trapped. Leaving extension element 40 free to rotate relative to handle 20 simplifies the possible connections of resistance elements to connector 50. Handle 20 can turn or change orientation as it moves through the path of an exercise swing, and while this is occurring, connector 50 can remain oriented or aimed in the direction of the exercising resistance to prevent any tangling or winding of exercising cords. Connector 50 can be the simple eye-ring illustrated, or can be made in many other ways such as holes, hooks, pins, and clamps. Exercising resistances can involve one or more cords or cables attached to connector 50, and this can be accomplished with simple clips, hooks, rings, or pins. Freedom of choice in such connections is enhanced by the rotatable capacity of extension element 40.

Figure 5:
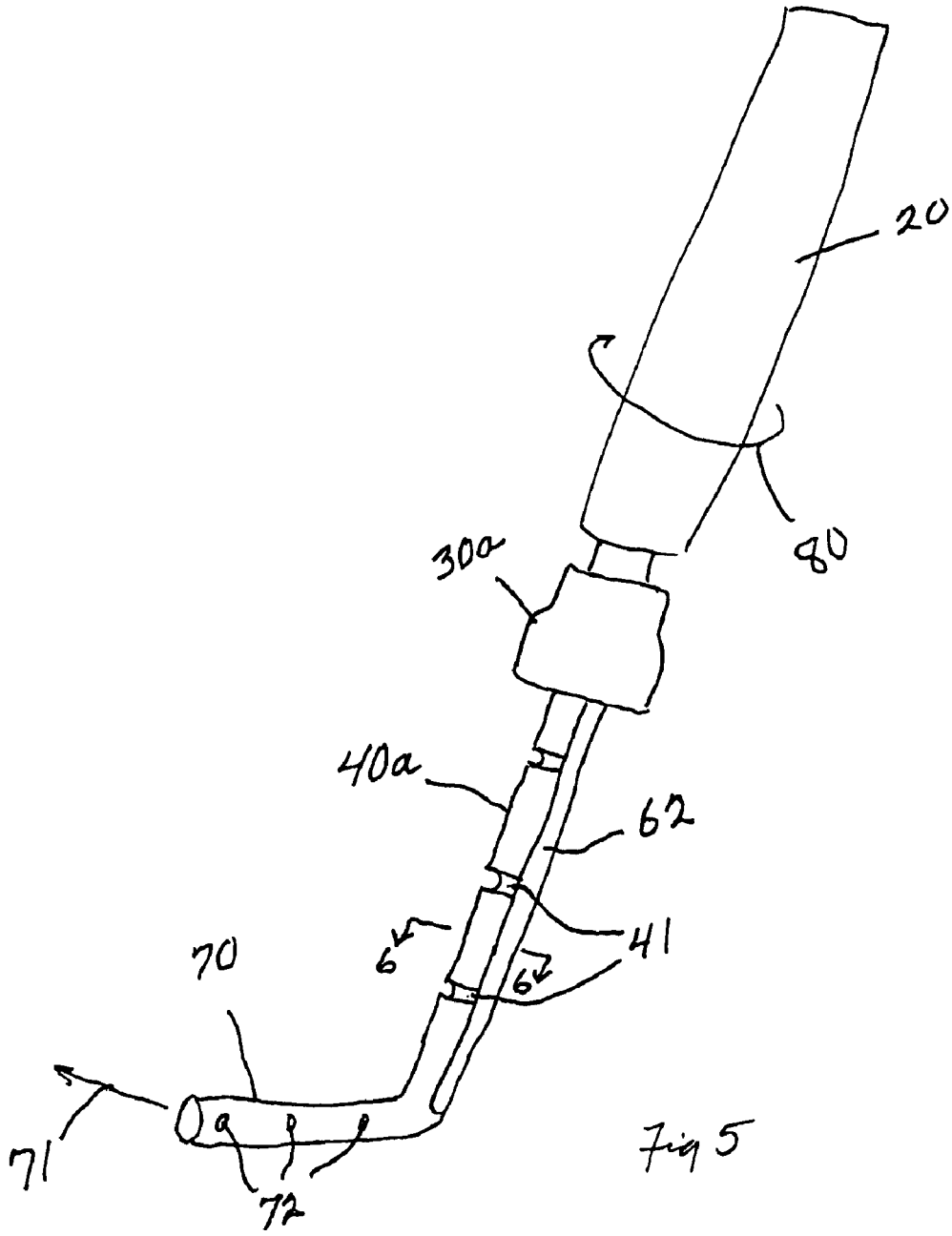
FIG. 5 is a perspective view of an exercising handle having an extendible handle shaft with an axially offset connection to an exercising resistance to combine handle torque with swing resistance.
Figure 8:
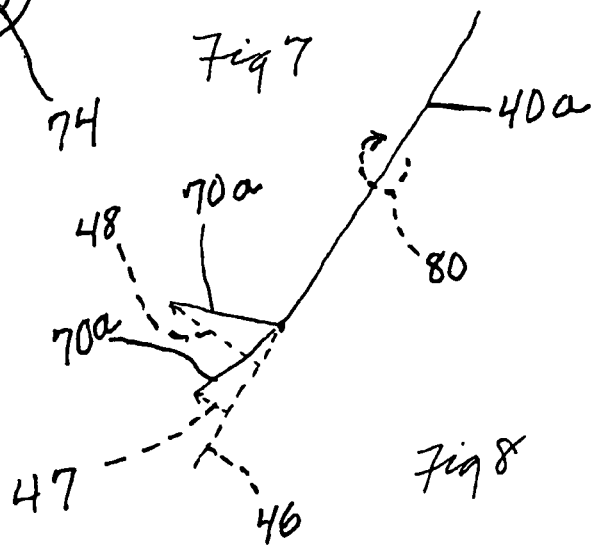
FIG. 8 is a schematic diagram of a handle shaft and its extended axis, with an angularly adjustable offset connector establishing vectors representing variable amounts of offset torque.

It is also possible, and even preferred for some exercising purposes, to make extendible handle shaft 40*a* non-rotatable relative to handle 20, as shown in FIG. 5. This can take advantage of an axially offset connection of a resistance element to handle shaft 40*a* to provide a torque force tending to rotate shaft 40*a* and handle 20. This torque force can then be overcome by-hands gripping handle 20 for exercising purposes. Such a torque-producing resistance connection is offset from an axis 46 of handle shaft 40*a*, as shown in FIG. 8, and preferably the amount of the axial offset is variable and adjustable. The axial offset is also oriented transverse to a swing motion so that the offset distance to a resistance provides a moment arm applying torque to shaft 40*a* as a swing progresses.

One simple expedient, as shown in FIG. 5 is an angularly offset projection or extension 70 that angles away from the longitudinal axis of shaft 40*a*. This can be similar to the way a golf club head angles from a golf club shaft or the way a blade of a hockey stick angles away from its shaft. An exerciser can then keep offset extension 70 aligned transversely of a swing path in the same way that a golf club head should be transverse to the swing of a golf club shaft so that extension 70 is perpendicular to the direction of a hit at the bottom center of a swing.

Making extension shaft 40*a* non-rotatable relative to handle 20 can be done by making shaft 40*a* non-circular in cross-section, and forming locking collar 30*a* with a mating non-circular configuration. A simple way to accomplish this is by forming a flat 62 or a pair of opposing flats 62 on extendible shaft 40*a*. Locking collar 30*a* can then have corresponding flats engaging surfaces 62 and can use two balls, rather than four balls, to lock in grooves 41.

A resistance 71 connected to offset extension 70 can resist swing movement and also require an exerciser's hands to hold handle 20 and extendible element 40*a* against rotational torque. This can strengthen the muscles involved in resisting shaft torque and can improve an exerciser's swing.

Figure 6:
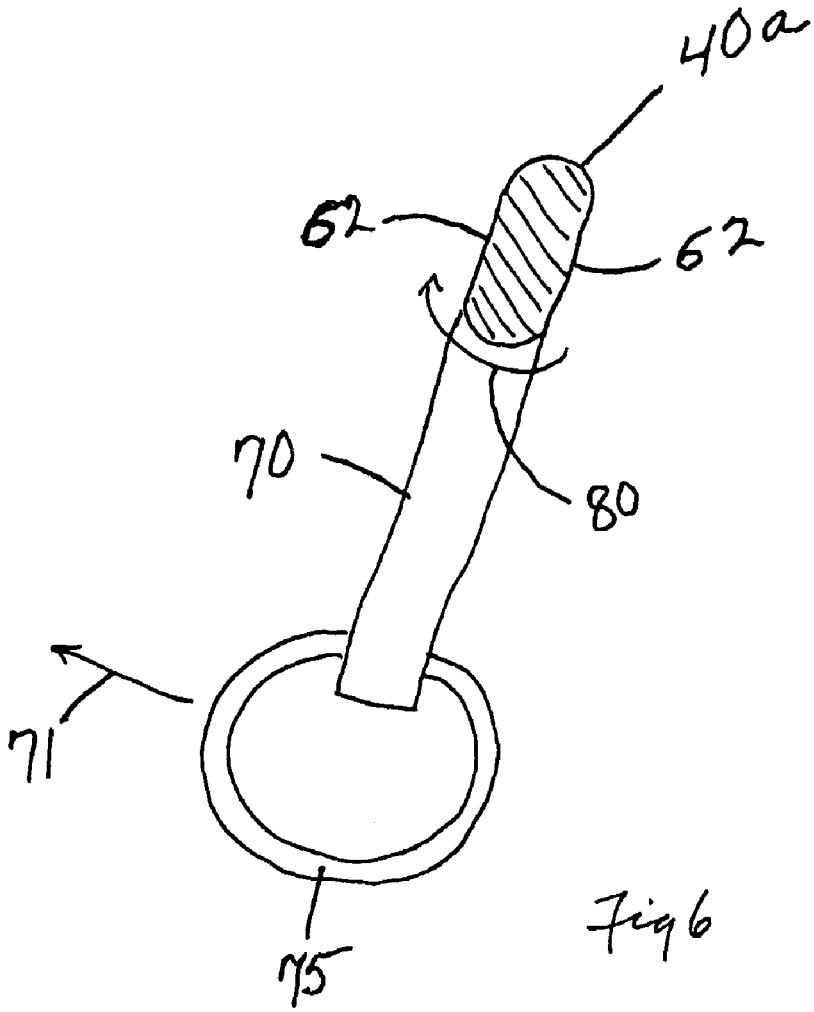
FIG. 6 is a cross-sectional view of the handle shaft of FIG. 5 taken along the line 6-6 thereof, and adding a ring for an offset connection to a resistance.

The amount of offset that extension 70 provides from the longitudinal shaft axis of extendible element 40*a* is preferably adjustable. One simple way to accomplish this is with a series of holes 72 spaced at different distances from the axis of shaft element 40*a* so that exercising resistance 71 can be connected to any one of the holes. A ring 75 is shown as another form of connector in FIG. 6, but connectors can also be hooks, snap hooks, clevises, etc. Generally, the farther the resistance connection is from the shaft axis, the longer is the torque moment arm, and the more torque is applied to the handle shaft during an exercising swing. Since swing resistance applied to handle 20 is preferably variable, independent adjustment of offset torque resistance adds much versatility. Swing resistance can be made heavy while torque resistance is light or vice versa, to train the muscles that need strengthening to optimize a swing.

Figure 7:
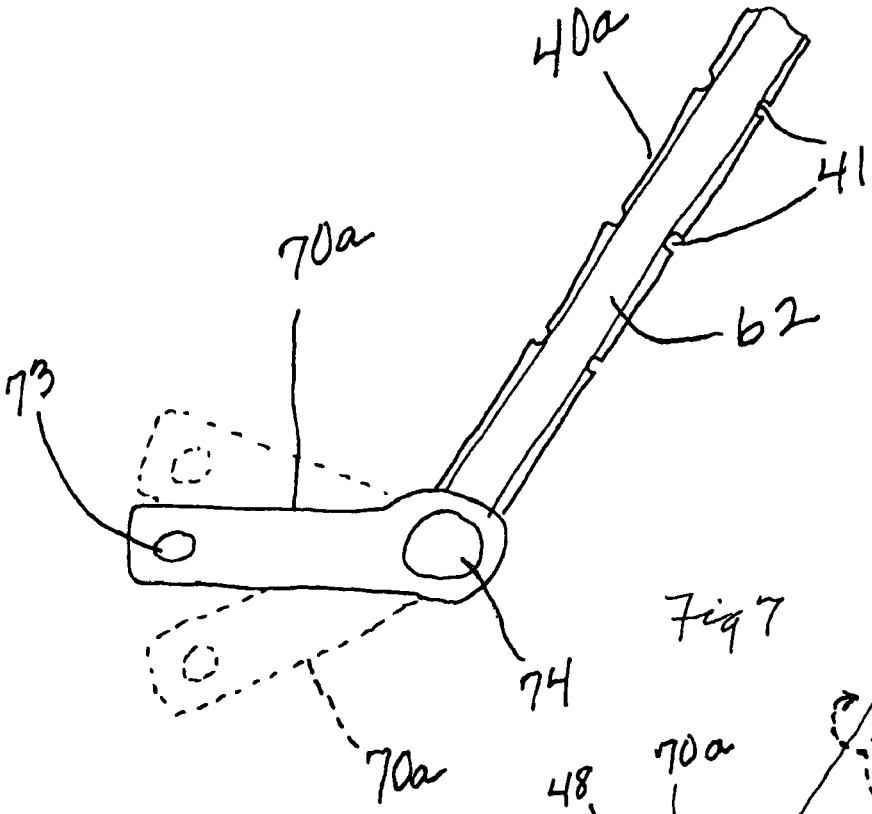
FIG. 7 is a fragmentary view of a handle shaft showing a preferred angularly adjustable offset connector.

Another way of adjusting the offset of an element 70*a* by angular adjustment is shown in FIG. 7. Offset 70*a* can have a single connecting hole 73 near its distal end, and can be angularly adjustable on shaft 40*a* as shown by the broken line positions of element 70*a*. Any desired angle for offset element 70*a* can be set by screw 74 or a clamp mechanism preferably arranged at the pivot axis of element 70*a*.

The way angularly adjustable offset 70*a* varies the torque resistance 80 applied to extendible element 40*a* is illustrated in the vector diagram of FIG. 8. When offset 70*a* is nearly aligned with shaft axis 46, a small vector 47, and a correspondingly small moment arm, represents the torque applied from a resistance, and when the offset angle moves 70*a* farther from axis 46, a larger vector 48, and a correspondingly larger moment arm, represents an increased torque resistance.

A golfer or other exerciser who wishes to develop a torque-resistant grip on handle 20 can vary the distance that a resistance is spaced from shaft axis 46, either by angularly adjusting element 70*a*, or by using different connector positions of a fixed angular offset 70. The exerciser can then work against weaker or stronger torque resistance to strengthen the muscles needed to hold handle 20 and shaft 40*a* in the correct orientation as a swing passes through a hitting region. The axially offset resistance connection can also be reversed between a connection above shaft 40*a* and a connection below shaft 40*a* to develop different sets of torque-resistant muscles. When a resistance is connected above shaft 40*a*, the torque to be resisted is exerted clockwise on shaft 40*a* from the point of view of the exerciser. When handle 20 and shaft 40*a* are inverted so that an offset resistance connection is below shaft 40*a*, then the torque to be resisted is counterclockwise from the point of view of the exerciser.

Torque resistance offered by offset extension 70 and 70*a*, as shown in FIGS. 5-8 can be exploited with split grip handles 90 as shown in FIGS. 9-13. Each split grip handle has a pair of independently adjustable grips 91 and 92 usable by the right and left hands, depending on whether an exerciser is right-handed or left-handed. Each grip has a corresponding grip adjustment sleeve 93 and 94 that allows each grip to be either rotationally fixed to handle shaft 95 or allowed to rotate relative to handle shaft 95.

Figure 9:
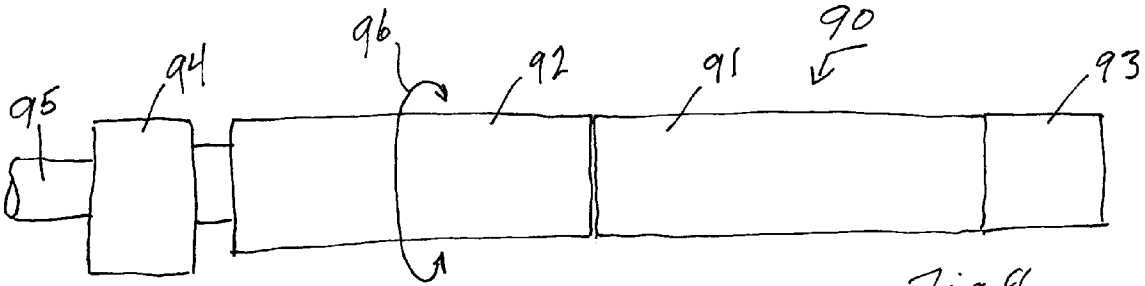
FIGS. 9-11 are partially schematic views of a split grip handle showing a rotatable forward grip and a fixed rear grip in FIG. 9, a fixed forward grip and a rotatable rear grip in FIG. 10, and fixed forward and rear grips in FIG. 11.
Figure 10:
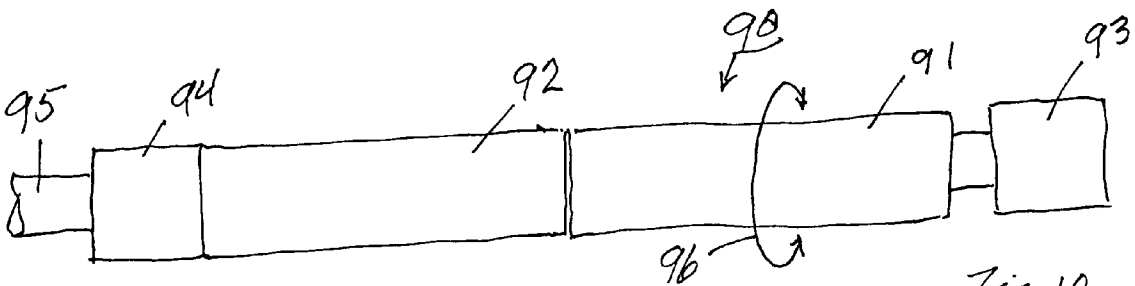
Figure 11:
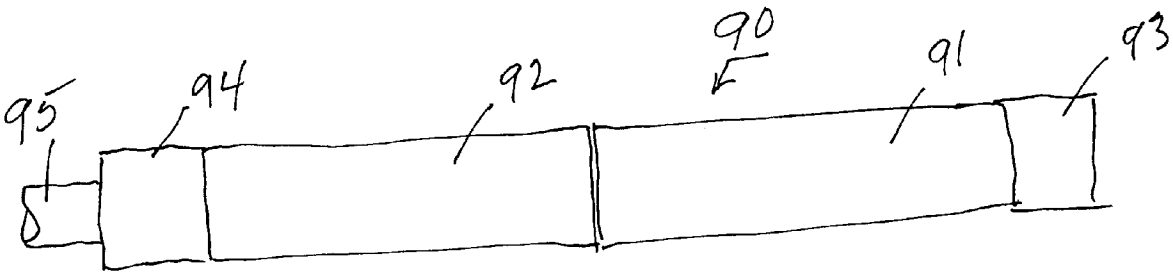

In the condition shown in FIG. 9, adjuster 94 has freed handle grip 92 to rotate in either direction, as indicated by the double headed arrow 96, relative to handle shaft 95. The opposite adjustment is shown in FIG. 10, where handle adjuster 93 is positioned to free grip 91 for rotating in either direction, as indicated by arrow 96. In FIG. 11, both grip adjusters 93 and 94 are positioned to fix each of the grips 91 and 92 so that neither are rotatable relative to handle shaft 95. The grip adjustments of FIGS. 9 and 10 can be made to require one of the hand grips to resist the rotational torque of a resistance while the other grip, by being rotationally loosened, is unable to resist rotational torque. This can strengthen the hand that holds the non-rotating grip and force it to do rotation-resisting work during an exercising swing. The adjustment of FIG. 11 allows both hands to work together for overcoming rotational torque, because both grips 91 and 92 are rotationally fixed on shaft 95. In such a condition, handle 90 becomes a conventional handle allowing both hands to resist any rotational torque that is applied. Another possible adjustment is for both adjusters 93 and 94 to loosen their respective grips 91 and 92 rotationally on shaft 95. This is not useful for overcoming rotational torque, but it can be used for an exerciser who does not want rotational resistance mixed in with swing resistance.

Figure 12:
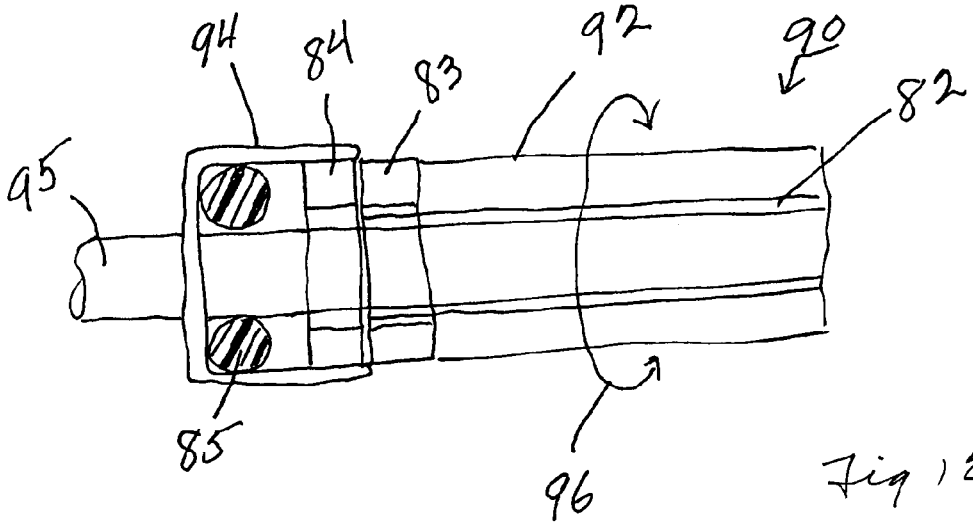
FIGS. 12 and 13 are partially schematic and partially sectioned views of a forward grip and its adjuster showing a rotatable grip position in FIG. 12 and a non-rotatable grip position in FIG. 13.
Figure 13:
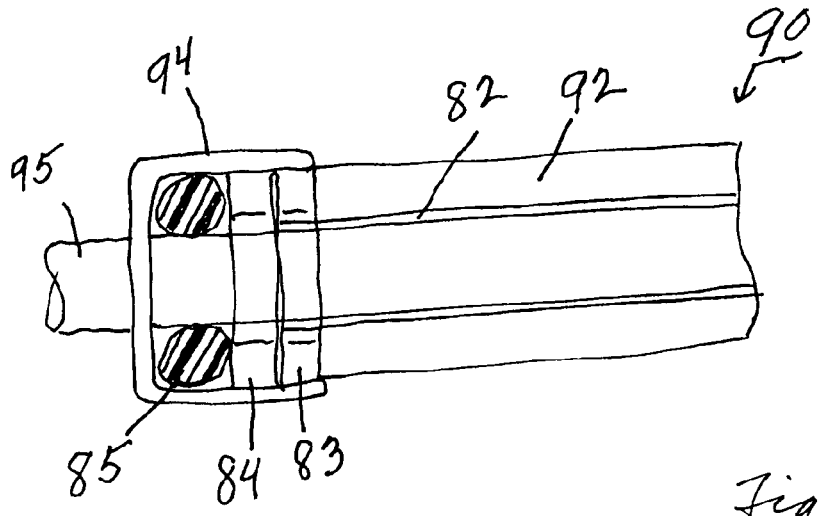

A preferred way of operating grip adjusters 93 and 94 is shown in FIGS. 12 and 13 relative to adjuster 94. A similar arrangement can be made for the other end of handle 90 for grip adjuster 93. Grip 92 is arranged on a sleeve 82 that is rotatable around handle shaft 95, and a non-circular element, such as hex nut 83 is fixed to sleeve 82. A similar hex nut 84 is fixed to shaft 95, and adjuster 94 can be a cup shaped like a wrench socket that is movable axially to fit over hex nuts 83 and 84. Cup or socket 94 preferably contains an O-ring 85 providing frictional resistance that holds adjuster 94 in either of the axially adjusted positions shown in FIGS. 12 and 13.

With adjuster 94 in the unlocked position shown in FIG. 12, grip 92 and its hex nut 83 are clear of adjuster 94 and are free to rotate around shaft 95, as indicated by arrow 96. In the locked position of adjuster 94, as shown in FIG. 13, socket 94 grips both of the hex nuts 83 and 84 and locks them together. Since nut 84 is fastened to shaft 95 and nut 83 is rotationally locked to nut 84 in the position of FIG. 13, grip 92 is also rotationally locked on shaft 95. A similar arrangement can be used for adjuster 93 on the other end of handle 90. All that is then necessary for rotationally adjusting independent grips 91 and 92 is moving adjusters 93 or 94 axially between locked and unlocked positions.

Although wrench sockets and hex-shaped nuts are inexpensive and convenient, other arrangements can also achieve the adjustment that is preferred and schematically illustrated in FIGS. 9-11 so that the exerciser can independently adjust the rotatability of split hand grips for exercising purposes. These include different non-circular shapes that can be attached to handle shaft 92, grip sleeve 82 and matching shaped adjuster 94.

When grip rotation adjustments are combined with adjustable offset extensions 70 and 70*a* as described above, they make exercising handles 20 and 90 into effectively variable exercising elements to suit the many different needs of exercisers. Making handle shafts 40 or 40*a* adjustable in axial length also adds to the exercising versatility. The possibilities include training or educating muscles, teaching the nervous system to know the effects of different muscle activities, and strengthening muscles that contribute desired characteristics to a swing.

What is claimed is:

1. An exercising handle having a connection to a resistance that resists a swing motion of the handle for exercising purposes, the exercising handle comprising:

the resistance connection is laterally offset from an axis of the handle; and the orientation of the offset of the resistance connection is transverse to the swing motion at a hitting region of the swing motion; and the resistance to the swing motion at the hitting region also applies to the handle a torque force tending to rotate the handle around the axis of the handle.

2. The exercising handle of claim 1 wherein a distance of the offset resistance connection from the handle axis is variable.

3. The exercising handle of claim 2 wherein the offset resistance connection is angularly adjustable relative to the axis of the handle.

4. The exercising handle of claim 1 wherein the handle includes split grips disposed to be gripped by respective hands of an exerciser; the split grips are selectively and independently connectable rotationally to a shaft of the handle; and a hand on a grip connected rotationally to the shaft is able to resist the torque force from the offset resistance connection.

5. The exercising handle of claim 1 wherein an axial distance from the handle to the offset connection is adjustable.

6. An exercising handle comprising:

a pair of independent handle grips disposed for gripping by respective hands of an exerciser;

each of the handle grips being selectively and independently connectable rotationally to the handle;

a resistance to movement of the handle for exercising purposes being applied to a region that is laterally offset from an axis of the handle; and the offset region of the resistance to the handle being oriented transverse to a swing motion of the handle at a hitting region to apply a torque force to the handle to be resisted selectively by either one of the hand grips that is rotationally connected to the handle.

7. The exercising handle of claim 6 wherein an angularly adjustable offset extension varies a position of the offset resistance region.

8. The exercising handle of claim 6 including an extendible element that varies an axial distance between the hand grips and the offset region.

9. An exercising handle comprising:

a handle combined with a resistance that provides both swing resistance and torque resistance as the handle moves in a swing motion;

a connection applying the resistance to the handle at a variable axis distance from the handle; and the connection being laterally offset by a variable distance from an axis of the handle in an orientation that applies a torque force to the handle at a hitting region of the swing.

10. The exercising handle of claim 9 having right- and left-hand grips that are independently adjustable to resist the torque force.

11. The exercising handle of claim 10 wherein each of the grips is independently connectable rotationally to a shaft of the handle so that the torque force can be applied selectively to either hand or to both hands.

12. The exercising handle of claim 9 wherein the offset connection is angularly adjustable relative to the axis of the handle.

* * * * *